US007595461B2

(12) United States Patent
Saxl et al.

(10) Patent No.: US 7,595,461 B2
(45) Date of Patent: Sep. 29, 2009

(54) HEAVY-DUTY CIRCUIT BREAKER WITH EROSION-RESISTANT SHORT-CIRCUIT CURRENT ROUTING

(75) Inventors: David Saxl, Zurich (CH); Markus Vestner, Busingen (CH); Thomas Nordstrom, Ludvika (SE); Tomas Borg, Ludvika (SE); Tomas Strom, Ludvika (SE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 11/812,315

(22) Filed: Jun. 18, 2007

(65) Prior Publication Data

US 2008/0006608 A1 Jan. 10, 2008

Related U.S. Application Data

(63) Continuation of application No. PCT/CH2005/000747, filed on Dec. 14, 2005.

(30) Foreign Application Priority Data

Dec. 23, 2004 (EP) ..... 04405796

(51) Int. Cl.
*H01H 33/88* (2006.01)

(52) U.S. Cl. ..... 218/59; 218/43; 218/51

(58) Field of Classification Search ..... 218/13, 218/43, 45, 48–55, 59, 62–65, 67, 72–74, 218/79, 80

See application file for complete search history.

(56) References Cited

U.S. PATENT DOCUMENTS 3,909,572 A 9/1975 Tsubaki et al.
4,412,115 A 10/1983 Okuno
4,628,164 A * 12/1986 Talpo ..... 218/65
4,716,266 A 12/1987 Muscaglione et al.

(Continued)

FOREIGN PATENT DOCUMENTS

EP 0 290 950 A1 11/1988

(Continued)

OTHER PUBLICATIONS

PCT/ISA/210 dated Mar. 21, 2006.

(Continued)

*Primary Examiner*—Elvin G Enad
*Assistant Examiner*—Marina Fishman
(74) *Attorney, Agent, or Firm*—Buchanan Ingersoll & Rooney PC

(57) ABSTRACT

The heavy-duty circuit-breaker having an axis (A), and having an arcing contact piece, a current-carrying element and an erosion protection element, with the arcing contact piece having an opening in order to carry an essentially axial flow of a gas which has been heated by an arc, and together with the current-carrying element forms a flat contact (F) in order to carry a short-circuit current (I) which flows through the arcing contact piece and the current-carrying element, and with the erosion protection element essentially shielding the current-carrying element from the flow close to the flat contact (F), is characterized in that the current-carrying element has an axial area in which a radial internal dimension (d2) of the current-carrying element increases in steps or continuously as the distance from the flat contact (F), measured parallel to the axis (A), increases.

19 Claims, 3 Drawing Sheets

U.S. PATENT DOCUMENTS 4,798,924 A * 1/1989 Ackermann ..... 218/43
5,216,214 A 6/1993 Willieme et al.
6,040,970 A * 3/2000 Lehmann et al. ..... 218/53

FOREIGN PATENT DOCUMENTS

EP 0 642 145 A1 3/1995
EP 0 932 172 A2 7/1999

OTHER PUBLICATIONS

International Preliminary Report on Patentability PCT/IPEA/409 dated Nov. 15, 2007 for PCT/CH2005/000747.

* cited by examiner

HEAVY-DUTY CIRCUIT BREAKER WITH EROSION-RESISTANT SHORT-CIRCUIT CURRENT ROUTING

RELATED APPLICATIONS

This application claims priority under 35 U.S.C. §119 to EP Application 04405796.6 filed in Europe on Dec. 23, 2004, and as a continuation application under 35 U.S.C. §120 to PCT/CH2005/000747 filed as an International Application on Dec. 14, 2005, designating the U.S., the entire contents of which are hereby incorporated by reference in their entireties.

TECHNICAL FIELD

The invention relates to the field of heavy-duty circuit-breaker technology, and in particular to a heavy-duty circuit-breaker.

BACKGROUND INFORMATION

A heavy-duty circuit-breaker is known from the prior art, which has a contact tulip as the arcing contact piece, which forms a flat contact with a current-carrying element in order to carry a short-circuit current. A tube composed of erosion-resistant material is provided within the contact tulip and extending into the current-carrying element, and is intended to protect the interior of the contact tulip against hot gas, with the gas being heated by an arc which is based on the arcing contact piece, and with the gas flowing through the contact tulip to beyond the current-carrying element.

Unless adequate protection is provided, a hot-gas flow such as this can remove material from the current-carrying element and/or from the contact tulip, as a result of which this can lead to degradation of the electrical contact between the contact tulip and the current-carrying element. This can result in increasing contact resistance, and even in failure of the contact.

The tube composed of erosion-resistant material is screwed into the current-carrying element and, in the part in which it is arranged within the contact tulip, has an external diameter which is larger than the internal diameter of the contact tulip at that respective point.

The provision of a tube such as this composed of erosion-resistant material considerably reduces the cross-sectional area available for the gas to flow through. If this cross-sectional area is intended to remain approximately constant, in order to maintain similar outlet-flow speeds, a larger contact tulip and a larger current-carrying element must be provided (for the same cross sections available for the short-circuit current), thus resulting in a heavy-duty circuit-breaker that is larger overall.

EP 0 642 145 A discloses a circuit breaker having male contact pin and contact tulip, in which the contact fingers of the tulip have an axial cutout in order to hold a tube therein, which is used as a radial-movement limiter for the contact fingers. A further protective tube, for protection against hot gas, is provided in the interior of the contact tulip, for thermal protection against erosion.

EP 0 290 950 A discloses a gas-blast circuit breaker which has contact fingers in the form of tulips as an arcing contact piece, which contact fingers, together with a cylindrical erosion contact, form the arcing contacts. A tubular body which can be moved axially is guided within the contact tulip and is pushed by a spring in the direction of the erosion contact during a disconnection process.

Furthermore, EP 0 932 172 A2 discloses a circuit breaker having a tulip contact piece, whose sprung arcing contacts and the tubular piece arranged thereon are protected against erosion by an arc-resistant insert. The flow cross section in the tulip contact piece is disadvantageously reduced because the insert rests internally on the arcing contacts and on the tubular piece.

It is therefore desirable to provide a heavy-duty circuit-breaker which is as compact as possible but nevertheless offers protection against the hot-gas-induced contact degradation that has been mentioned.

SUMMARY

The object of the invention is therefore to provide a heavy-duty circuit-breaker of the type mentioned initially, which does not have the disadvantages mentioned above. One particular aim is to provide a compact heavy-duty circuit-breaker, that is to say a heavy-duty circuit-breaker with small external dimensions, which has a low electrical resistance, which does not increase as a result of hot-gas-induced contact degradation over time, between an arcing contact piece and a current-carrying element which carries a short-circuit current away from the arcing contact piece.

This object is achieved by an apparatus having the features of patent claim 1.

The heavy-duty circuit-breaker according to the invention having an axis which defines an axial coordinate parallel to the axis and a radial coordinate at right angles thereto has an arcing contact piece, a current-carrying element and an erosion protection element. The arcing contact piece has an opening in order to carry an essentially axial flow of a gas which has been heated by an arc which may be based on the arcing contact piece. In order to carry a short-circuit current which flows through the arcing contact piece and the current-carrying element for the time during which the arc burns, it forms, together with the current-carrying element, a flat contact. The erosion protection element essentially shields the current-carrying element from the flow close to the flat contact.

The contact-carrying element has an axial area in which a radial internal dimension of the current-carrying element increases in steps or continuously as the distance from the flat contact, measured parallel to the axis, increases.

The heavy-duty circuit-breaker is characterized in that the axial area is intended to hold the erosion protection element. This allows the radial external dimensions of the heavy-duty circuit-breaker to be kept very small.

The invention can also be seen in that the heavy-duty circuit-breaker is characterized in that the current-carrying element has an axial area (that is to say an area defined by its axial extent) at whose end facing the flat contact a radial internal dimension of the current-carrying element is less than at its end remote from the flat contact. That end of the area which faces the flat contact is advantageously directly on the flat contact or adjacent to the flat contact.

The invention makes it possible to provide a large-area contact between the arcing contact piece and the current-carrying element (with a correspondingly low contact resistance) and protection against hot-gas-induced contact degradation (on the large-area contact) at the same time. This allows the heavy-duty circuit-breaker to be very compact and to have a long life.

The current-carrying element can advantageously be inclined, preferably even from the flat contact with the arcing contact piece.

The axial area is advantageously arranged on that side of the flat contact which faces away from the arcing contact piece. The axial area is advantageously arranged close to the arcing contact piece.

In one preferred embodiment, the current-carrying element and the erosion protection element are essentially rotationally symmetrical. The entire heavy-duty circuit-breaker is advantageously rotationally symmetrical. The radial internal dimension is preferably the internal diameter. The radial external dimension of the erosion protection element is preferably its external diameter.

A radial external dimension of the erosion protection element and the radial internal dimension of the current-carrying element are preferably matched to one another in the axial area. This allows the circuit breaker to be physically compact. The erosion protection element is advantageously fitted into the current-carrying element.

The erosion protection element preferably extends as far as the arcing contact piece. The erosion protection element may be extended precisely as far as the arcing contact piece (so that arcing contact piece and the erosion protection element touch one another), or beyond it (that is to say until there is an area in which the erosion protection element and the arcing contact piece overlap axially). The erosion protection element can also be extended axially (only) as far as the axial extent of the arcing contact piece (so that the areas of the axial extent of the arcing contact piece and the erosion protection element touch one another without any overlap).

The erosion protection element advantageously has a more erosion resistant material than the current-carrying element close to the flat contact. At least that side of the erosion protection element which faces the hot-gas flow is advantageously composed of an erosion-resistant material such as this, and the entire erosion protection element is preferably manufactured from a material such as this. That part of the current-carrying element which, if it were to be subjected to a hot-gas flow, would lead particularly quickly to degradation of the contact between the arcing contact piece and the current-carrying element is arranged close to the flat contact. This part is advantageously protected against degradation by hot gas by the more erosion-resistant material of the erosion protection element.

In one preferred embodiment, there is a second axial area in which a radial internal dimension of the erosion protection element is essentially the same as a radial internal dimension of the arcing contact piece. The radial internal dimension of the current-carrying element and the radial external dimension of the erosion protection element are particularly advantageously of the same magnitude (within manufacturing tolerances) in the axial area. In other words, a radial internal dimension of the erosion protection element is essentially of the same magnitude as the radial internal dimension of the arcing contact piece close to the flat contact. This allows the heavy-duty circuit-breaker to be physically particularly compact.

A heavy-duty circuit-breaker may have an outlet-flow tube in order to carry the hot-gas flow. The outlet-flow tube is used to carry a flow of a gas which has been heated by an arc which may be based on the arcing contact piece. In this case, it is highly advantageous for the erosion protection element to be firmly connected to the outlet-flow tube. It is particularly advantageous for the outlet-flow tube and the erosion protection element to be formed integrally. This makes it easier to manufacture and install the heavy-duty circuit-breaker. The erosion protection element is advantageously integrated in the outlet-flow tube.

The current-carrying element is advantageously firmly connected to an auxiliary nozzle, which surrounds the arcing contact piece. The current-carrying element is advantageously used to support an insulating nozzle arrangement (comprising at least one main nozzle and at least one auxiliary nozzle), or to hold it, or the current-carrying element is firmly connected to a support or holder such as this, or is formed integrally with it.

The flat contact is advantageously aligned essentially radially. At least the flange contact does not exclusively extend along the horizontal coordinate.

The current-carrying element and/or the arcing contact piece can advantageously be provided with a coating in order to reduce the contact resistance on a surface which contributes to the flat contact, preferably (in each case) over the entire surface which contributes to the flat contact. A coating such as this may, for example, be a silver coating.

In one advantageous embodiment, a rated-current contact system is also provided in addition to the arcing contact piece. When the circuit-breaker is in the closed state, this system carries a rated current, while the current is commutated onto an arcing contact system, which includes the arcing contact piece, after disconnection of the rated-current contact piece. After the disconnection of the arcing contact piece, an arc is struck which must be quenched and carries the short-circuit current. It is also possible for the arcing contact piece together with a further arcing contact piece to form a rated-current contact system.

A heavy-duty circuit-breaker is typically designed to carry short-circuit currents between 2 kA and 80 kA at rated voltages of between 10 kV and more than 1000 kV, preferably between 30 kV and 550 kV.

Further preferred embodiments and advantages will become evident from the dependent patent claims and from the figures.

BRIEF DESCRIPTION OF THE DRAWINGS

The subject matter of the invention will be explained in more detail in the following text using preferred exemplary embodiments, which are illustrated in the attached drawings, in which, schematically.

Figure 1:
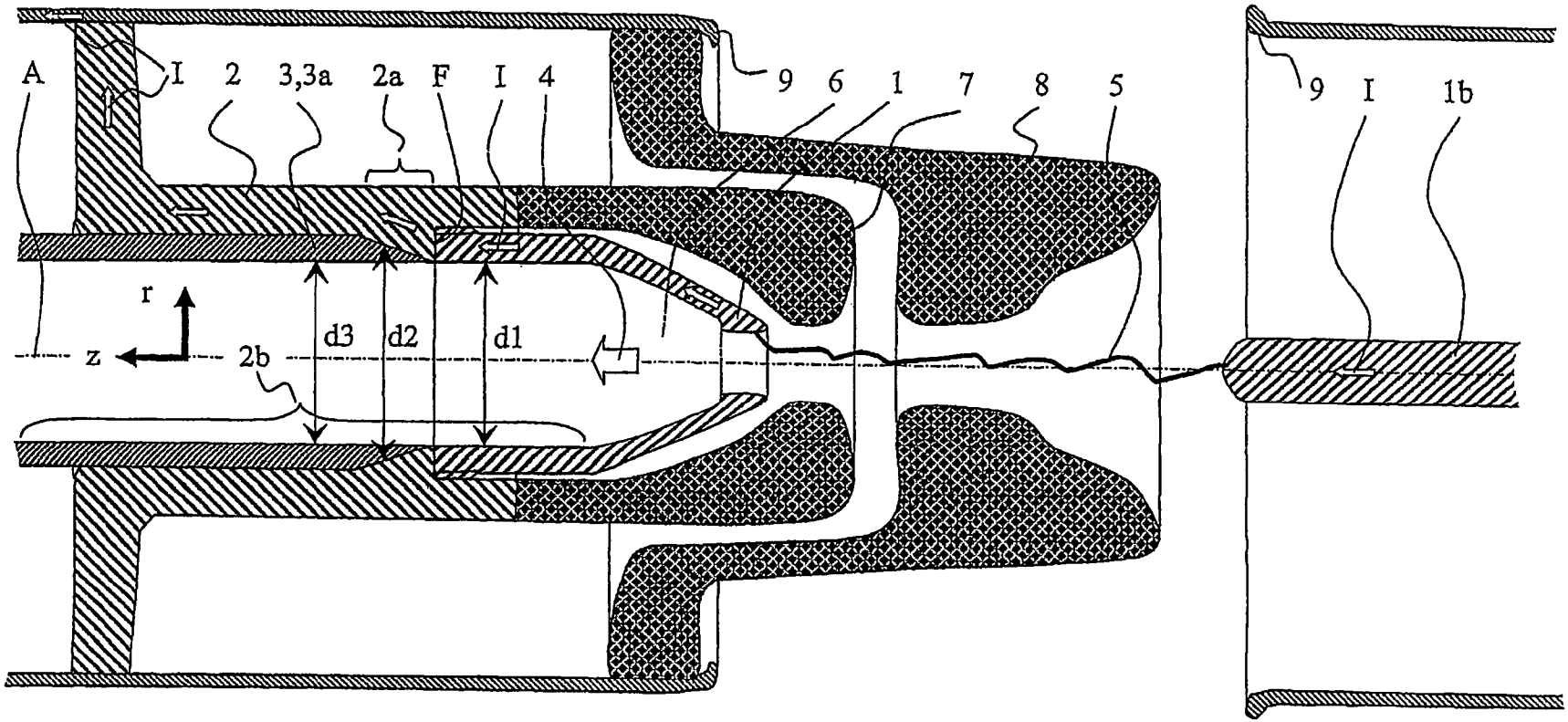
FIG. 1 shows a large detail of a heavy-duty circuit-breaker according to the invention, sectioned.

The reference symbols used in the drawings, and their meanings, are listed in summarized form in the list of reference symbols. In principle, identical parts or parts having the same effect are provided with the same reference symbols in the figures. Parts which are not significant for understanding of the invention are in some cases omitted. The described exemplary embodiments represent examples of the subject matter according to the invention, and have no restricting effect.

DETAILED DESCRIPTION

FIG. 1 shows, schematically and sectioned, a detail of a heavy-duty circuit-breaker according to the invention, in the open switching state. The heavy-duty circuit-breaker is essentially rotationally symmetrical with a rotation axis A, which defines an axial coordinate, annotated z, and a radial coordinate, annotated r. In order to open the switch, a rated-current contact system 9 which comprises two rated-current contacts 9 is opened first of all, so that the current flowing through the circuit breaker is commutated onto an arcing contact-piece system, which comprises two arcing contact pieces 1, 1*b*. After disconnection of the two arcing contact pieces 1, 1*b*, an arc 5 is struck between them, and a short-circuit current I, symbolized by thin open arrows, flows through the two arcing contact pieces 1, 1*b*.

The arcing contact piece 1 is in the form of a contact tulip with a multiplicity of contact fingers, and has an opening 6. A quenching gas 4 that is provided in the circuit breaker, for example $SF_6$, is heated by the arc 5 and, possibly together with further gaseous material, forms a gas flow 4 (symbolized by thick open arrows), which flow through the opening 6.

The short-circuit current I flows through a radially aligned flat contact F at the end of the contact tulip 1 in to a current-carrying element 2, and from there on to the connections of the circuit breaker. An erosion protection element 3*a* is provided between the current-carrying element 2 and the arcing contact piece 1 in order to protect the current-carrying element 2 and, in particular, the flat contact F against the gas flow 4, and is in this case formed integrally with an outlet-flow tube 3.

The current-carrying element 2 is in general composed of a less erosion-resistant (heat-resistant) material (for example aluminum or copper) than the erosion protection element 3*a* which, for example, may be composed of steel or a carbon-fiber-composite material. By way of example, the arcing contact piece 1 may be manufactured from copper, steel or tungsten-copper.

The entire bottom surface of the arcing contact piece 1 is used as a contact surface F for the current-carrying element 2, and, from there, the current-carrying element 2 is protected by the erosion protection element 3*a* against the gas flow 4. If suitable materials are used, there is no need for any additional protection for the arcing contact piece 1 against erosion, so that the erosion protection element 3*a* need protect only the contact surface F and that part of the current-carrying element 2 that is close to the contact surface against hot gas.

As is illustrated in FIG. 1, the contact tulip 1 may be screwed into the current-carrying element 2. Only a negligible amount of current can flow between the arcing contact piece 1 and the current-carrying element 2 through a thread, so that the outer surface of the contact tulip makes no contribution to the contact area.

The internal diameter d2 of the current-carrying element 2 increases continuously in an area 2*a* which starts close to the contact surface F, in particular on the contact surface F. The external diameter of the erosion protection element 3*a* increases to the same extent. The internal diameter of the erosion protection element 3*a* in an axial area 2*b* (or at least close to the contact surface F) is the same as the internal diameter dl of the arcing contact piece 1 close to the contact surface F.

This results in a large outlet-flow cross section being provided for the gas 4 flowing away through the arcing contact piece 1, while the external dimensions of the circuit breaker remain small, and the cross-sectional area F available for the short-circuit current I is very large.

The current-carrying element 2 in this case also has the function of holding an insulating auxiliary nozzle 7 and, via a metallic tube (which also carries one of the rated-current contact pieces 9), an insulating main nozzle 8. Both of the arcing contact pieces 1, 1*b* or else only one of the two may be designed to move. The arcing contact piece 1, the outlet-flow tube 3, the guide-carrying element 2, the insulating nozzle arrangement 7, 8 and the rated-current contact 9 which is arranged on the insulating nozzle side can be firmly connected to one another.

The other figures show, schematically and sectioned, possible refinements of the area close to the flat contact F, as are possible in a heavy-duty circuit-breaker as shown in FIG. 1 or else in some other circuit breaker having an arcing contact piece 1, a current-carrying element 2 and an erosion protection element 3*a*.

Figure 2:
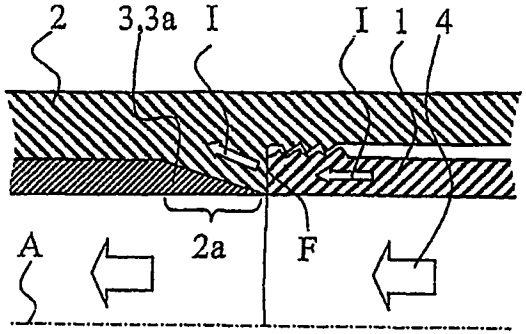
FIGS. 2 to 10 each show a detail, illustrating one possible embodiment of the arcing contact piece, current-carrying element and erosion protection element, sectioned.

FIG. 2 shows the embodiment from FIG. 1, with the thread being illustrated more clearly. The illustration is somewhat idealized since some surfaces may be close to one another, because of manufacturing tolerances. This problem will be discussed in conjunction with FIG. 3.

Figure 3:
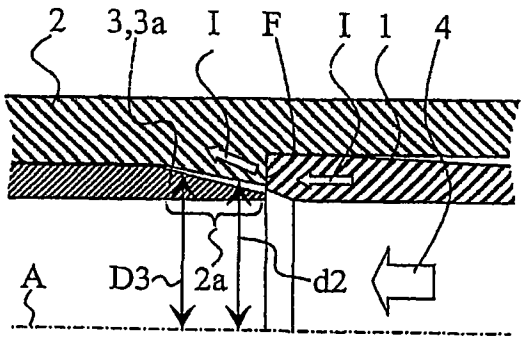

As FIG. 3 shows, the contact piece 1 may also be pushed into the current-carrying element 2 rather than being connected to it by means of a thread. This is an example of an interlocking connection. Furthermore, in order to overcome problems associated with the fit of the erosion protection element 3*a* in to the current-carrying element 2 as a result of manufacturing tolerances, the incline on the erosion protection element 3*a* may be less pronounced than the incline on the current-carrying element 2, as is illustrated in FIG. 3. In consequence, the internal diameter d2 of the current-carrying element 2 and the external diameter D3 of the erosion protection element 3*a* are of different size for the same axial coordinate z.

As FIG. 3 also shows, the contact tulip 1 may also have an incline, thus overcoming fit problems relating to the erosion protection element 3*a*, caused by manufacturing tolerances. Furthermore, FIG. 3 illustrates that a butt end can be provided on the erosion protection element 3*a*.

Figure 4:
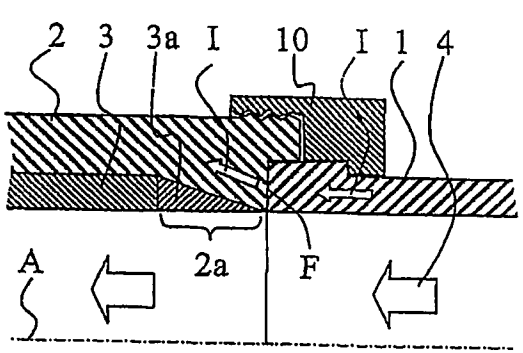

FIG. 4 shows a further example of an implementation, showing how contact pressure that leads to a low contact resistance can be achieved on the contact surface 6. The arcing contact piece 1 is pushed against the current-carrying element by means of a union nut 10 or a flange 10. FIG. 4 also shows that the erosion protection element 3*a* may also be arranged separately from the outlet-flow tube 3.

Figure 5:
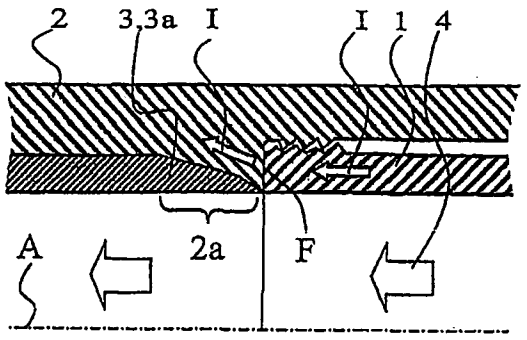

FIG. 5 shows that it is also possible to provide a plurality of inclines on the current-carrying element 2 and/or erosion protection element 3*a*.

Figure 6:
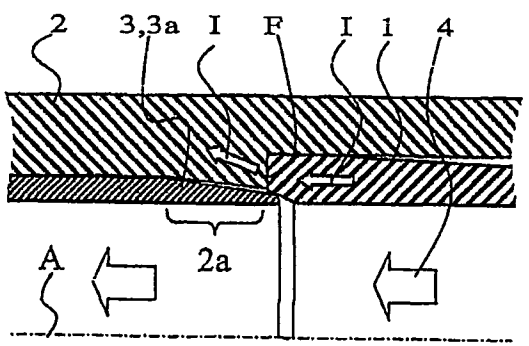

FIG. 6 shows that it is also possible to provide for the erosion protection element 3*a* to extend beyond the extent of the arcing contact piece 1, with respect to the axial coordinate.

Figure 7:
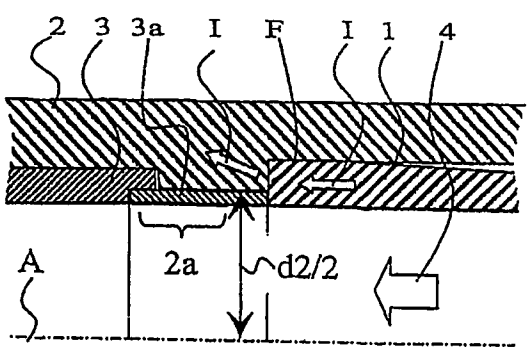

FIG. 7 shows a further embodiment, in which the erosion protection element 3*a* is arranged separately from the outlet-flow tube 3. This also shows that it is possible to provide for the internal diameter d2 of the current-carrying element 2 to be increased in steps (in this case in one step; however, two, three or more steps are also feasible). (Since FIG. 7 shows the circuit breaker only as far as the axis of symmetry A, half of the internal diameter, that is to say d2/2, is indicated).

Another embodiment may also be particularly advantageous in which the internal diameter d2 is increased in steps, as illustrated in FIG. 7, in a first area, and increases in the form of inclines in a second area, as illustrated in FIG. 5. However, conversely, it is also possible for the internal diameter d2 to be increased by inclines in a first area, and to be increased in steps, in a second area.

Figure 8:
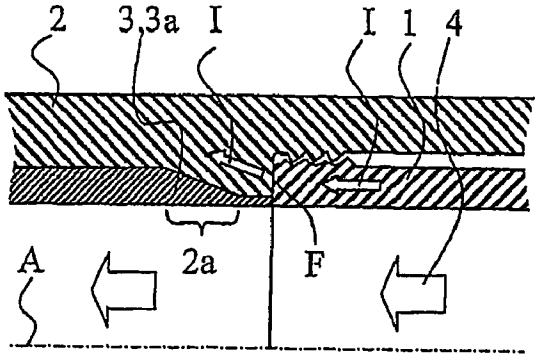

FIG. 8 shows an embodiment in which the erosion protection element 3*a* and the current-carrying element 2 first of all have a constant external diameter, or internal diameter as appropriate, and then an inclined area in the direction of larger radial coordinates, starting from the flat contact F and in the direction predetermined by the coordinate z. This ensures better erosion resistance at the expense of a slightly smaller contact area F.

Figure 9:
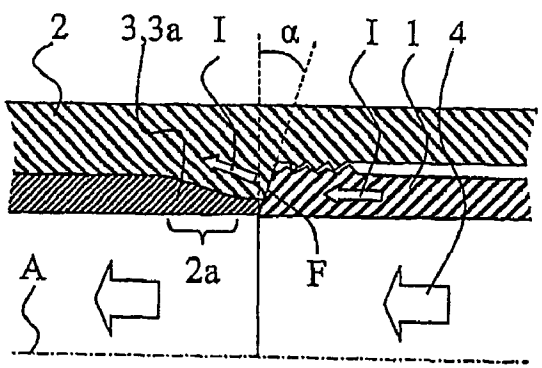

The embodiment in FIG. 9 is similar to that shown in FIG. 8 but shows that the flat contact F need not be aligned essentially radially. It may include an angle α which differs considerably from zero with an axis running along the coordinate r. As illustrated in FIG. 9, the angle α may be negative, although positive angles α0 are also possible.

Figure 10:
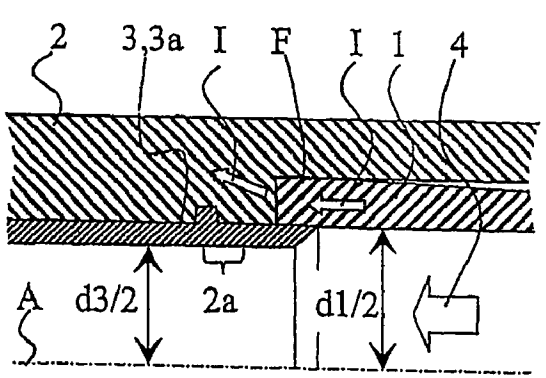

FIG. 10 shows an embodiment in which the internal diameter d3 of the erosion protection element 3*a* is somewhat smaller than the internal diameter dl of the arcing contact piece 1. Furthermore, the. erosion protection element 3*a* extends from that side of the contact surface F to which the current-carrying element 3 is predominantly adjacent to that side of the contact surface F to which the arcing contact piece 1 is predominantly adjacent. This results in better protection against erosion on the contact surface F. Furthermore, the formation of the erosion protection element 3*a* and the current-carrying element 2 in the area 2*a* provide a snap-action mechanism, which is used to attach the two parts to one another.

The features illustrated in the figures may also be advantageous in combinations other than those mentioned or illustrated.

LIST OF REFERENCE SYMBOLS

1 Arcing contact piece, contact tulip, contact tube
1*b* Arcing contact piece, contact pin
2 Current-carrying element, holder
2*a*, 2*b* Area, axial area
3 Outlet-flow tube
3*a* Erosion protection element
4 Gas, quenching gas, flow, quenching-gas flow
5 Arc
6 Opening in the arcing contact piece
7 Auxiliary nozzle
8 Nozzle, main nozzle
9 Rated-current contact, rated-current contact system
10 Union nut, flange
A Axis
D3 Radial external dimension of the erosion protection element, external diameter
d1 Radial internal dimension of the arcing contact piece, internal diameter
d2 Radial internal dimension of the current-carrying element, internal diameter
d3 Radial internal dimension of the erosion protection element, internal diameter
I Current, short-circuit current, arcing current
F Flat contact, contact surface
r Radial direction, radial coordinate
z Axial direction, axial coordinate
α Angle

What is claimed is:

1. A heavy-duty circuit-breaker having an axis (A) which defines an axial coordinate (z) parallel to the axis and a radial coordinate (r) at right angles to the axis, and having an arcing contact piece, a current-carrying element and an erosion protection element, with the arcing contact piece having an opening in order to carry a substantially axial flow of a gas which has been heated by an arc which may be based on the arcing contact piece, and together with the current-carrying element forms a flat contact surface (F) in order to carry a short-circuit current (I) which flows through the arcing contact piece and the current-carrying element for the time during which the arc burns, and with the erosion protection element substantially shielding the current-carrying element from the flow close to the flat contact (F), and with the current-carrying element having an axial area in which a radial internal dimension (d2) of the current-carrying element increases in steps or continuously as the distance from the flat contact (F), measured parallel to the axis (A), increases, wherein the axial area is intended to hold the erosion protection element, wherein a radial external dimension (D3) of the erosion protection element is matched to the radial internal dimension (d2) of the current-carrying element in the axial area, with the erosion protection element being radially adjacently fitted into the current-carrying element, wherein the erosion protection element extends from a region of the flat contact surface in an axial direction of the current-carrying element opposite the arcing contact piece.

2. The heavy-duty circuit-breaker as claimed in claim 1, wherein the current-carrying element and the erosion protection element are designed to be essentially rotationally symmetrical, and in that the radial internal dimension (d2) is the internal diameter (d2).

3. The heavy-duty circuit-breaker as claimed in claim 1, wherein the erosion protection element (3*a*) extends axially as far as the arcing contact piece (1).

4. The heavy-duty circuit-breaker as claimed in claim 1, wherein the erosion protection element has a more erosion-resistant material than the current-carrying element close to the flat contact surface (F).

5. The heavy-duty circuit-breaker as claimed in claim 1, wherein, in a second axial area, a radial internal dimension (d3) of the erosion protection element is substantially the same as a radial internal dimension (d1) of the arcing contact piece.

6. The heavy-duty circuit-breaker as claimed in claim 1, wherein an outlet-flow tube is provided in order to carry the flow, and wherein the erosion protection element is firmly connected to the outlet-flow tube.

7. The heavy-duty circuit-breaker as claimed in claim 1, wherein the current-carrying element is firmly connected to an auxiliary nozzle, which surrounds the arcing contact piece.

8. The heavy-duty circuit-breaker as claimed in claim 1, wherein the flat contact surface (F) is aligned substantially radially.

9. The heavy-duty circuit-breaker as claimed in claim 1, wherein a rated-current contact system is provided in addition to the arcing contact piece.

10. The heavy-duty circuit-breaker as claimed in claim 1, wherein the internal dimension (d2) of the current-carrying element increases continuously or continuously with a pure step or a plurality of steps in an area starting close to the contact surface (F).

11. The heavy-duty circuit-breaker as claimed in claim 1, wherein the internal dimension (d2) of the current-carrying element increases in a plurality of inclines in an area starting close to the contact surface (F).

12. The heavy-duty circuit-breaker as claimed in claim 1, wherein the arcing contact piece is screwed into the current-carrying element.

13. The heavy-duty circuit-breaker as claimed in claim 5, wherein an outlet-flow tube is provided in order to carry the flow, and wherein the erosion protection element is firmly connected to the outlet-flow tube.

14. The heavy-duty circuit-breaker as claimed in claim 6, wherein the current-carrying element is firmly connected to an auxiliary nozzle, which surrounds the arcing contact piece.

15. The heavy-duty circuit-breaker as claimed in claim 7, wherein the flat contact surface (F) is aligned essentially radially.

16. The heavy-duty circuit-breaker as claimed in claim 8, wherein a rated-current contact system is provided in addition to the arcing contact piece.

17. The heavy-duty circuit-breaker as claimed in claim 9, wherein the internal dimension (d2) of the current-carrying element increases continuously or continuously with a pure step or a plurality of steps in an area starting close to the flat contact surface (F).

18. The heavy-duty circuit-breaker as claimed in claim 10, wherein the internal dimension (d2) of the current-carrying element increases in a plurality of inclines in an area starting close to the flat contact surface (F).

19. The heavy-duty circuit-breaker as claimed in claim 11, wherein the arcing contact piece is screwed into the current-carrying element.

* * * * *